US005669371A

United States Patent [19]

Rupprecht et al.

[11] Patent Number: 5,669,371

[45] Date of Patent: Sep. 23, 1997

[54] MASONRY SLITTING APPARATUS

[75] Inventors: Hans Rupprecht, München; Leopold von Keudell, Eching, both of Germany

[73] Assignee: Hilti Aktiengeschaft, Furstentum, Liechtenstein

[21] Appl. No.: 622,532

[22] Filed: Mar. 25, 1996

[30] Foreign Application Priority Data

Mar. 30, 1995 [DE] Germany ..... 195 11 721.2

[51] Int. Cl.[6] ..... B28D 1/04

[52] U.S. Cl. ..... 125/13.01; 125/13; 125/12

[58] Field of Search ..... 125/13.01, 13, 125/13.02, 14, 12, 16.03, 28; 451/358, 352; 16/111 R, 111 A; 83/881, 886, 887, 879

[56] References Cited

U.S. PATENT DOCUMENTS

| | | | |
|---|---|---|---|
| 2,736,311 | 2/1956 | Coates | 125/14 |
| 3,357,745 | 12/1967 | Cooper | 451/352 |
| 4,310,198 | 1/1982 | Destree | 125/14 |
| 4,953,523 | 9/1990 | Swan | 451/352 |
| 5,167,215 | 12/1992 | Harding, Jr. | 125/14 |
| 5,381,780 | 1/1995 | Yelton et al. | 125/14 |
| 5,452,943 | 9/1995 | Campbell | 125/14 |

FOREIGN PATENT DOCUMENTS 3315245 11/1989 Germany .

*Primary Examiner*—James G. Smith
*Assistant Examiner*—Derris H. Banks
*Attorney, Agent, or Firm*—Anderson Kill & Olick, P.C.

[57] ABSTRACT

A masonry-slitting apparatus has a housing (1) containing a drive unit (2) for a slitting member (4), and a trolley (3) on which the housing (1) is pivotally mounted about a rotary bearing (6) located in a first end region of the housing. The housing (1) has a first handle (10) in the first end region and a second handle (9) in a second end region at the opposite end from the first end region. Each handle (9, 10) has a substantially cylindrically shaped gripping surface (12, 13) extending parallel to one another and disposed at right angles to a disk plane of the slitting member (4). An electric switch (5) is located in the gripping surface (13) of the first handle (10) and a locking switch (11), actuating an arresting element (8), is located in the gripping surface (12) of the second handle (9).

7 Claims, 3 Drawing Sheets

MASONRY SLITTING APPARATUS

BACKGROUND OF THE INVENTION

The present invention is directed to a masonry slitting apparatus having a housing with a first handle at a first end region and a second handle at an opposite second end region and with a drive unit mounted in the housing for operating a slitting tool comprising at least one disk forming a disk plane extending transversely of the end regions. The slitting tool is actuated by an electric switch. The housing is pivotally mounted on a trolley against the force of a spring element and it moves pivotally in the disk plane of the slitting tool. The housing is pivotally movable about a rotary bearing located in the first end region of the housing. An arresting member is located in the second end region of the housing and is actuated by a locking switch located in the second handle at the second end region of the housing for limiting the pivotal movement between the housing and the trolley.

When effecting electrical installations in new buildings additions to buildings, or renovated buildings, it is necessary to lay electric tubes or conduits which serve for receiving individual electric cables. In various concrete members, such as floors, ceilings or walls, the electric conduits are, as a rule, fastened to the form work before it is poured. Masonry slitting members are used for laying electric conduits protruding from concrete structural members in masonry walls whereby two slits extending parallel to one another are milled in the masonry or brick walls. The depth and spacing of the slits from one another depends upon the quantity and diameter of the electric ducts to be placed. The portion of the masonry or brick wall located between the slits is broken out by means of a suitable tool, so that a receiving groove for the electric conduits is formed.

The masonry slitter with a housing having two handles, a drive unit for the slitter consisting of at least one disk actuatable by an electric switch and a trolley is disclosed in DE-OS 38 15 245. The housing is pivotable about a rotary bearing against the force of a spring element parallel to a disk plane of the slitting member and an arresting member is provided for limiting the pivotal movement between the housing and the trolley, and the arresting member can be actuated by a locking switch located in one of the handles.

The drive unit of this known tool can be switched on without need for touching by hand one of the handles. The danger of injury exists if one hand grips the handle with simultaneous actuation of the locking switch and pivots the housing against the trolley when the trolley is not resting fully on the surface of the base material which is to be worked. The rotating slitting tool protruding downwardly from the trolley can initially be applied precisely to a marking on the base material. If, while this operation is being effected, the hand gripping the trolley gets within the range of the slitting tool because of lack of attention, great injury, especially to the area of the hand, can result.

In certain instances the slitting operation must be carried out at considerable heights and it is necessary to climb a ladder providing a situation wherein safety cannot be disregarded. It is possible that the person operating the apparatus may fall off the ladder and be injured by the apparatus, in particular if the operator falls on the apparatus. Even if the trolley is lifted off the base material and the housing automatically pivots by means of the spring element to an initial position relative to the trolley and is secured by means of the arresting and locking member against additional pivoting, the arresting and locking member can be damaged because of a strong impact. As a result, the trolley can be pressed against the housing and the slitting tool driven by the driving unit projects beyond the trolley and injures the operator.

The arrangement of the handles does not assure a secure contact pressure of the apparatus against the surface of the masonry while the slits are being cut. The handle containing the locking switch has a gripping area with its axis extending parallel to the disk plane of the slitting member in the working position of the apparatus and is inclined in the outward direction towards the plane of the trolley. The contact pressure force exerted manually is transmitted only very unsatisfactorily in this way to the handle so that the fatigue phenomena rises very rapidly. Such a situation results in slits of different depths.

SUMMARY OF THE INVENTION

Therefore, the primary object of the present invention is to provide a masonry slitting apparatus capable of forming slits in masonry or brick work rapidly, precisely, securely and without inducing fatigue in the operator.

In accordance with the present invention, both handles are provided with substantially cylindrically shaped gripping areas where the axis of the gripping areas runs substantially at right angles to the disk plane of the slitting disk as well as parallel to one another, and with an electric switch disposed in a first handle.

The contact pressure applied manually by the operator can, due to the inventive arrangement of the handles, be transmitted to the apparatus in an improved manner. The fingers of both hands required for actuating the electric switch and the locking switch are basically freely mobile when exerting pressure on the apparatus, since the contact pressure force passes mainly from the hand surfaces to the handles without the hands being able to slide off the gripping areas. Since the locking switch is disposed in a second handle, and the electric switch is in the first handle, each hand must grip respectively one handle for actuating each of the switches just as in the case of a "two-hand steering system". When the electric switch is released, the driving unit switch is off and the disk-shaped slitting member stops. If, on the other hand, the locking switch and the second handle are released, then the housing and trolley move apart under the force of the prestressed spring member, whereby the slitting members no longer protrude beyond the trolley.

When slits must be produced in masonry, which is difficult to gain access to and particularly in corners, it is necessary that the apparatus be held off center, in order to avoid injury in the form of abrasions to the hands of the operator. For this purpose, the lengths of the gripping areas of the handles comprising the locking switch and the electric switch preferably correspond to 0.5 to 1 times the width of the housing measured perpendicularly to the disk plane of the slitting members.

For production reasons, the locking switch and the electric switch were disposed in the handles and each switch comprises strip-like keys which extend parallel to the axis of the gripping areas. Preferably, the keys are arranged in the middle of the gripping areas. This particular arrangement and disposal of the keys permits right-handed and left-handed operators to operate the tool in an identical manner.

To permit the locking switch and the electric switch to be operated, if the handles are gripped off-center, the length of the keys corresponds preferably to 0.5 to 1 times the length of the gripping regions.

Gripping the gripping regions occurs as a rule from the outside, so that the fingers of both hands grip below the bottom side of the gripping regions and rest on the inner side of the gripping regions. A suitable actuation of the locking switch and the electric switch can be achieved by means of the fingers, if the keys of the locking switch and the electric switch are disposed facing one another.

Very little force is required before actuating the keys of the locking switch and the electric switch, if the effective direction of the keys of the locking switch and the electric switch are disposed to be inclined downwardly toward the trolley.

To make the best use possible of the force applied by the fingers, the keys of both switches are disposed in such a way at the gripping regions of the handles that the effective direction of the keys enclose an angle of 80° to 180°.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
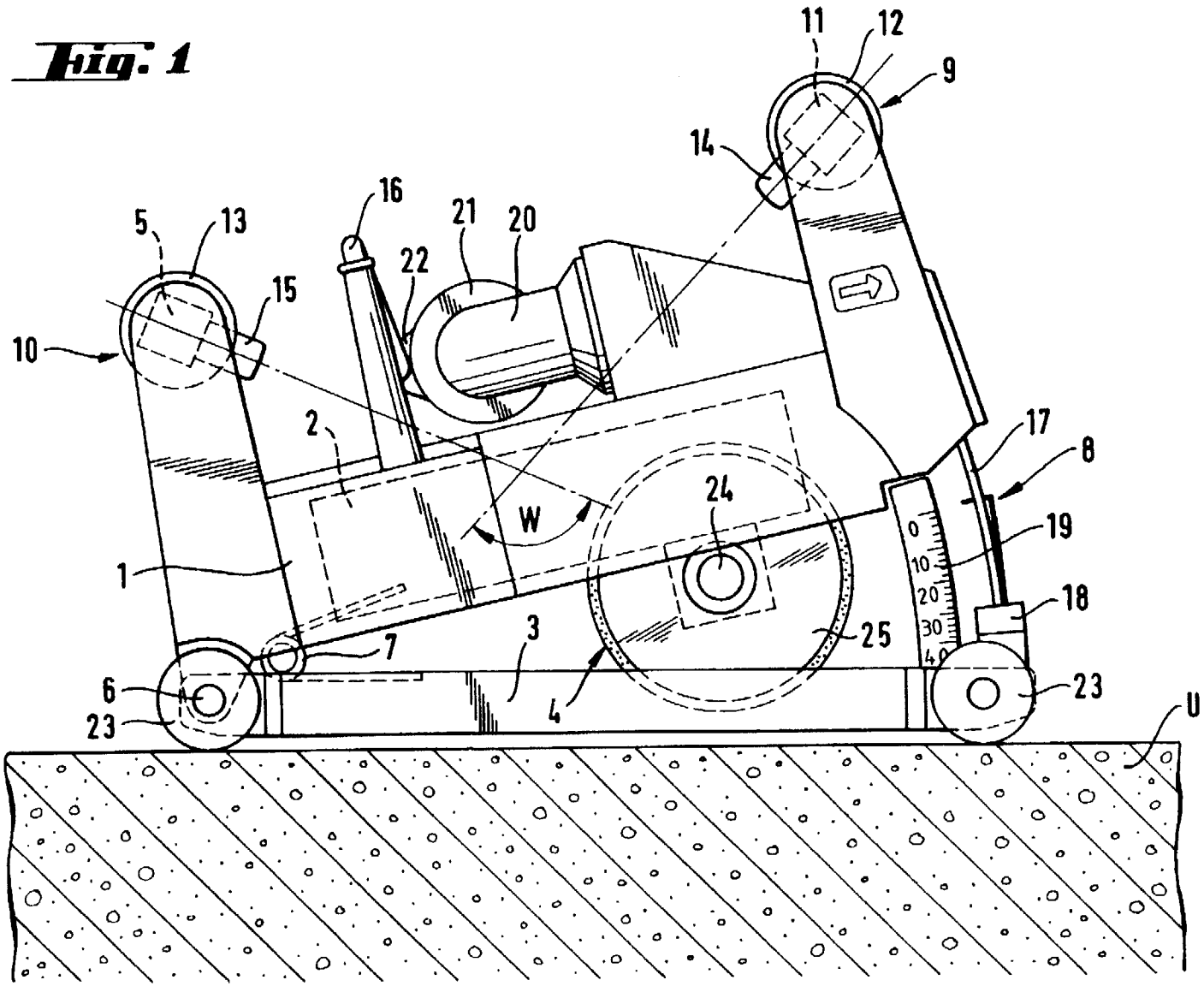
FIG. 1 is a side elevation view of a masonry slitting apparatus embodying the present invention and shown in a neutral or at rest position.
Figure 2:
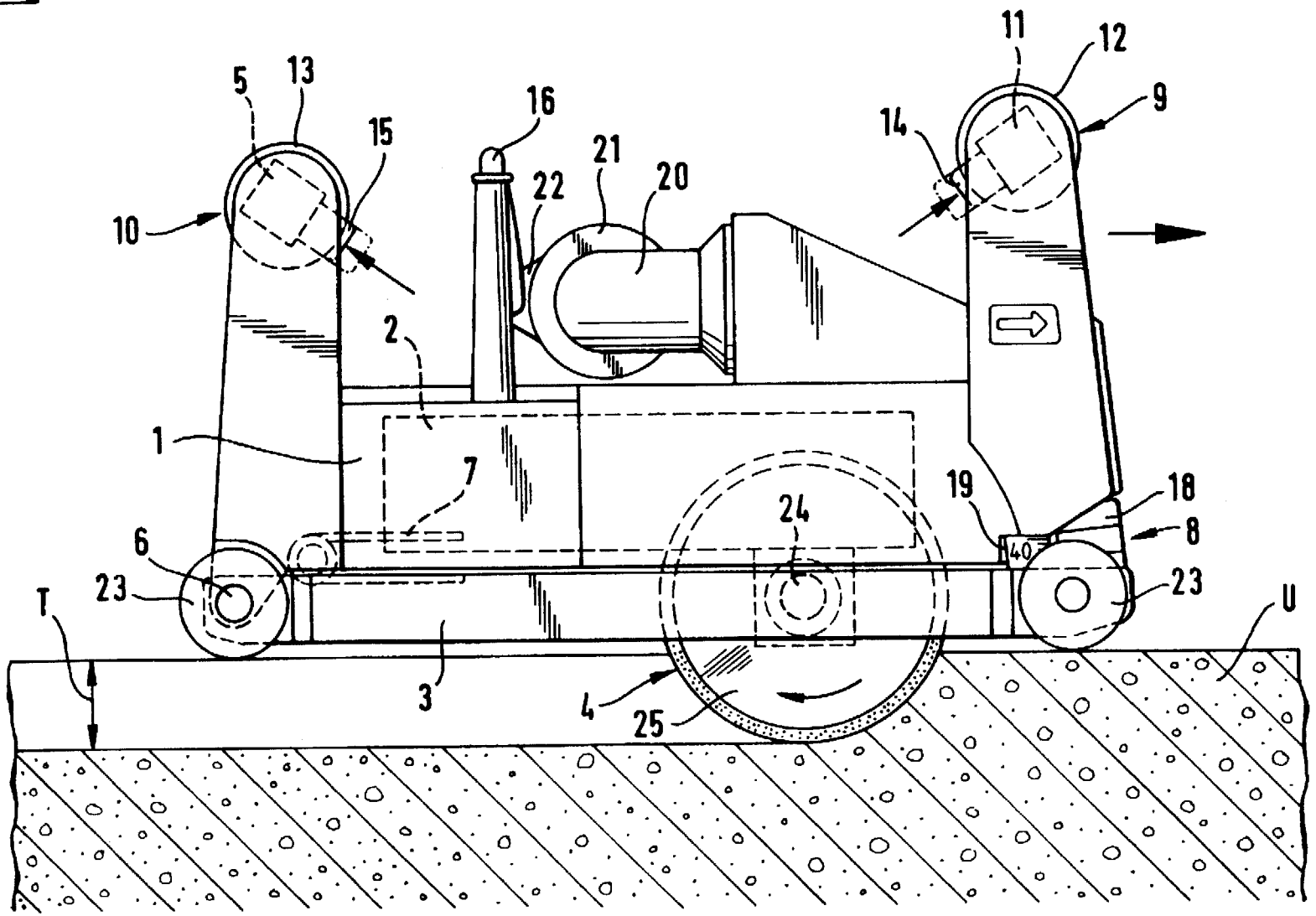
FIG. 2 is a view similar to FIG. 1, however, with the apparatus illustrated in the working position.
Figure 3:
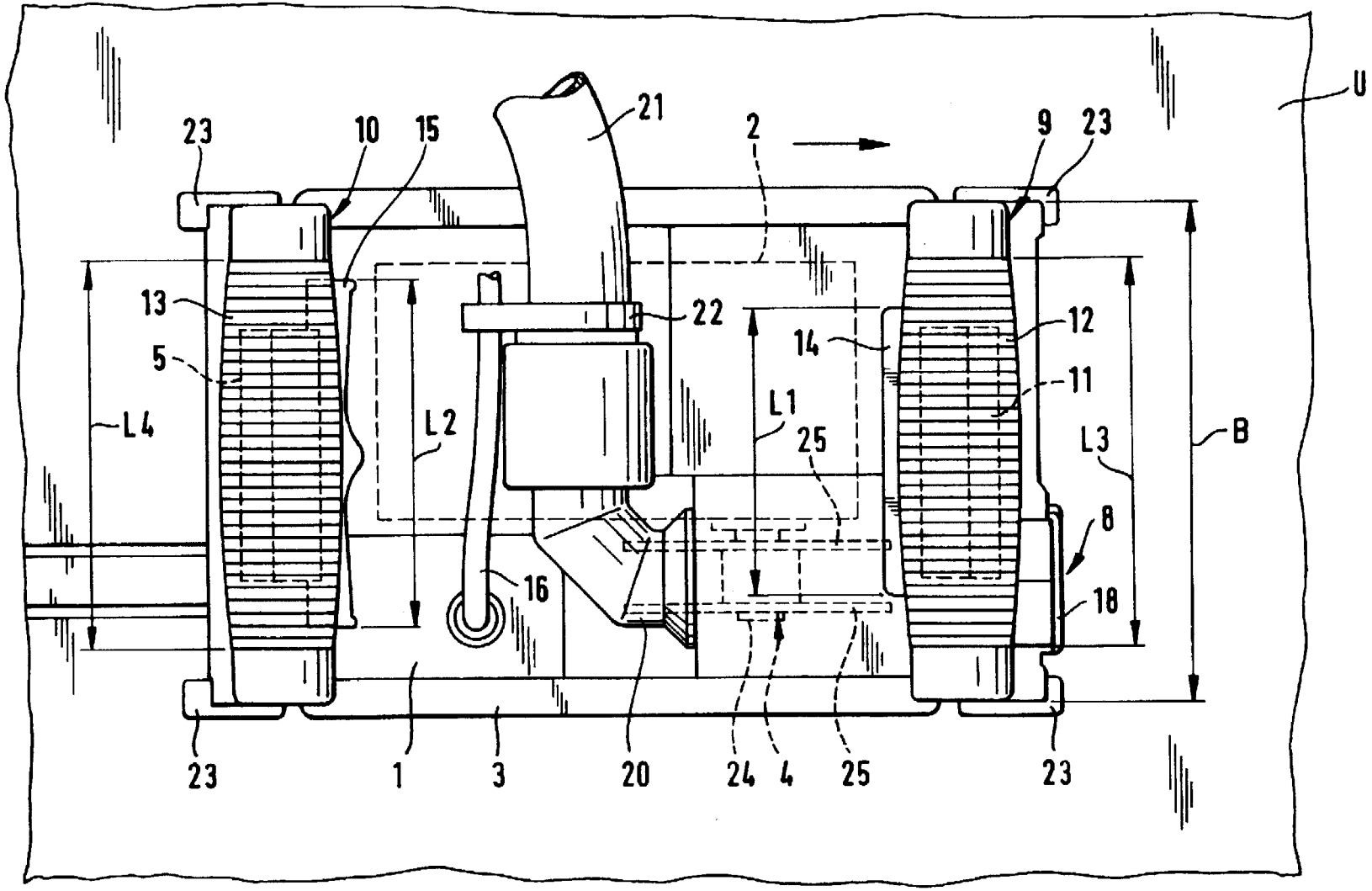
FIG. 3 is a plan view of the masonry slitting apparatus in the working position as shown in FIG. 2.

The masonry-slitting apparatus illustrated in FIGS. 1, 2 and 3 is formed of a housing 1 of substantially rectangular shape as viewed in plan and having a width D, note FIG. 3, a drive unit 2, shown in phantom, for operating a slitting member 4 formed of two disks 25 located next to one another with the drive unit connected to the slitting member. The disks form a plane extending parallel to the long sides of the housing extending between the end regions. The housing 1 is pivotally mounted on the trolley 3 for pivotal movement parallel to the disk plane of the slitting member 4 and pivoting around a rotary bearing 6 against the force of a spring element 7. As viewed in the drawings, the housing has a first end region at the left hand and a second end region at the right hand end. The rotary bearing 6 is disposed in the first end region of the housing.

The housing 1 has a first handle 10 located in the first end region where the housing is pivotally connected to the trolley by the rotary bearing 6 and has a second handle 9 at the second end region. Each of the handles 9, 10 has a substantially cylindrically shaped gripping region (12, 13) extending parallel to the respective end regions of the housing 1.

An electric switch 5, for turning the drive unit to "on", is disposed in the gripping region 13 of the first handle 10 located in the first end region of the housing 1.

A locking switch 11 is located in the gripping region 12 of the second handle 9 located in the second end region of the housing 1 and when actuated displaces an arresting or stopping element 8 which serves to limit the extent of the pivoting motion between the housing 1 and the trolley 3.

Each of the electric switch 5 and the locking switch 11 is provided with a strip-shaped push button 15, 14 extending radially outwardly from the gripping regions 13, 12 and extending for approximately the entire length L4, L3 of the gripping regions 13, 12, note FIG. 3. In FIG. 3, the length of the push button 14 is indicated by L1 and the length of the push button 15 is indicated by L2. The push buttons 14, 15 of both switches are arranged facing one another on the inner sides of the gripping regions 12, 13 and are inclined downwardly towards the trolley 3 with an effective direction of the push buttons 14, 15 enclosing an angle W of 110°, note FIG. 1.

A link, not shown, is disposed between the electric switch 5 and its respective push-button 15 so that an unintended engagement of the drive unit can be prevented; the link must be displaced relative to the button 15 by an amount parallel to the axial extent of the gripping region 13 before the push button 15 can be displaced in a radial direction relative to the axis of the gripping region 13.

If the locking switch 11 has not been depressed, the arresting element 8 actuated by the locking switch is in the locked position and abuts a locking rail 17 projecting outwardly from the trolley 3. A depth stop 18 is disposed a the locking rail 17 and can be adjusted step-wise along the locking rail 17. The depth stop 18 can be adjusted to a desired slit-depth T by an adjustment scale 19 also extending outwardly from the trolley 3. When the locking switch 11 has been actuated, the housing can be pivoted relative to the trolley until it comes to rest at the depth stop 18 as shown in FIG. 2. The slitting member then projects downwardly from the trolley 3 by an amount previously adjusted by means of the depth stop 18.

A motor shaft, not shown, of the drive unit 2 is located in the housing 1 and extends in the long direction of the housing 1 that is between the ends. A gear box, not shown, connected to the drive unit 22 has a drive shaft 24 extending at right angles to the long direction of the housing 1, that is right angles to the side regions of the housing, with the slitting member 4 formed of two disks 25 being connected to the drive shaft.

A suction nozzle 20 is located on the top side of the housing 1 between the two handles 9, 10 with a suction hose 21 connected to the nozzle. The suction hose 21 is mounted in retention elements 22 by means of which an electric cable 16 protruding from housing 1 between the handles 9, 10 can be clipped to the suction hose 21.

As shown in FIG. 3, the apparatus has a substantially rectangularly-shaped outside contour, this refers to both the housing 1 and the trolley 3. Rollers 23 are arranged at the corners of the trolley 3 for facilitating movement of the trolley 3 over the surface of the base material U in which the slits are to be formed. The rollers are arranged so that displacement of the trolley 3 or of the entire apparatus can only be effected in the direction extending parallel to the long sides of the apparatus. The rollers are set inwardly relative to the sides of the trolley 3, so that rotation of the rollers can be assured when one long side of the trolley extends along a wall, not shown, or along a longitudinal stop. The rotary bearing 6 is shaped as an axle with its central axis extending co-axially with the rollers 23 at the first end region of the housing. As indicated above, the housing 1 has a rectangular outside shape corresponding mainly to the outside shape of the trolley 3.

While specific embodiments of the invention have been shown and described in detail to illustrate the inventive principles, it will be understood that the invention may be embodied otherwise without departing from such principles.

What we claim is:

1. Masonry-slitting apparatus comprising a housing (1) having a first end region a second end region and side regions extending between the end regions, a first handle (10) located in said first end region and a second handle (9) located in said second end region, a drive unit (2) mounted in said housing (1), an electric switch (5) for actuating said drive unit (2), a slitting member (4) connected to said drive unit for rotating at least one disk (25) for effecting a slit in a base material (U), said housing (1) being pivotally mounted on a trolley (3) about a rotary bearing (6) disposed in the first end region of said housing (1) and being pivotally displaceable against the biasing force of a spring element (7), said at least one disk (25) forming a disk plane extending between and transversely of said end regions and said housing being pivotally displaceable parallel to said disk plane, an arresting element (8) located in the second end region of said housing for limiting pivotal movement between said housing (1) and said trolley (3), said arresting element (8) being actuated by a locking switch (11) located in said second handle (9), each said handle (9, 10) having a substantially cylindrically-shaped gripping surface (12, 13) extending substantially perpendicularly to said disk plane and parallel to one another, and said electric switch (5) being located in said first handle.

2. Masonry-slitting apparatus as set forth in claim 1, wherein said gripping surfaces (12, 13) of said handles (9, 10) have lengths (L3, L4) and include said locking switch 11, and said electric switch (5) and the lengths thereof correspond to 0.5 to 1 times the width (B) of said housing (1) measured at right angles to the disk plane of the slitting member (4).

3. Masonry-slitting apparatus, as set forth in claim 1, or 2, wherein said locking switch (11) and said electric switch (5) each comprise a strip-shaped push button (14, 15) located in the gripping surfaces (12, 13) and extending parallel to the end regions of said housing.

4. Masonry-slitting apparatus as set forth in claim 3, wherein each of said push buttons (14, 15) has a length (L1, L2) in the range of 0.5 to 1.0 times the length (L3, L4) of said gripping surfaces (12, 13).

5. Masonry-slitting apparatus, as set forth in claim 4, wherein said push buttons (14, 15) of said locking switch (11) and said electric switch (5) are located facing one another on the gripping surfaces (12, 13).

6. Masonry-slitting apparatus, as set forth in claim,5, wherein said push-buttons (14, 15) are inclined downwardly from said gripping surfaces (12, 13) towards said trolley (3).

7. Masonry-slitting apparatus, as set forth in claim 6, wherein a projection of the inclination of said push buttons (14, 15) intersect and form an angle (W) in the range of 80° to 180°.

* * * * *

UNITED STATES PATENT AND TRADEMARK OFFICE

CERTIFICATE OF CORRECTION

PATENT NO. : 5,669,371
DATED : September 23, 1997
INVENTOR(S) : Hans Rupprecht, et. al.

It is certified that error appears in the above-identified patent and that said Letters Patent is hereby corrected as shown below:

Title page, item [73], Assignee: should read as following:
-- Hilti Aktiengesellschaft, Fürstentum, Liechtenstein--.

Signed and Sealed this

Sixteenth Day of December, 1997

Bruce Lehman

*Attest:*

BRUCE LEHMAN

*Attesting Officer*

*Commissioner of Patents and Trademarks*